US007063363B2

(12) United States Patent
Fishencord

(10) Patent No.: US 7,063,363 B2
(45) Date of Patent: Jun. 20, 2006

(54) APPARATUS FOR RETAINING A RETRACTOR MECHANISM IN A LOCK ASSEMBLY

(75) Inventor: Eric E. Fishencord, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 10/366,160

(22) Filed: Feb. 13, 2003

(65) Prior Publication Data

US 2004/0160069 A1 Aug. 19, 2004

(51) Int. Cl.
*E05B 3/08* (2006.01)

(52) U.S. Cl. ..... 292/336.5; 292/DIG. 64

(58) Field of Classification Search ..... 292/336.5, 292/165, 169, 337, DIG. 64, 359, 169.15, 292/169.16

See application file for complete search history.

(56) References Cited

U.S. PATENT DOCUMENTS 1,751,101 A * 3/1930 Schlage ..... 292/169.19
1,981,289 A * 11/1934 Schlage ..... 292/337
2,836,452 A * 5/1958 Kubik et al. ..... 292/169.18
3,287,046 A * 11/1966 Russell et al. ..... 292/169.22
3,927,905 A * 12/1975 Erickson ..... 292/169.22
4,428,212 A * 1/1984 Best et al. ..... 70/224
5,004,278 A * 4/1991 Kang et al. ..... 292/169.18

OTHER PUBLICATIONS

Photograph of Lock Assembly, Manufactured by Yale Security Group, dated Feb. 7, 2003.
Photograph of Lock Assembly, Manufactured by Best Access Systems (formally "Best Lock Corporation") dated Feb. 7, 2003.

* cited by examiner

*Primary Examiner*—Gary Estremsky
(74) *Attorney, Agent, or Firm*—Michael Best & Friedrich LLP

(57) ABSTRACT

A retainer apparatus including a retainer clip having a back component, a pair of side plate components, and a pair of front plate components that hold a retractor mechanism for extending and retracting a latch of a lock assembly. The retainer apparatus allows the retractor mechanism to be pre-assembled, ready for connection to a pre-assembled chassis of the lock assembly. One embodiment of the retainer clip is a single formed piece having a back component with at least one post for supporting a spring, side components to provide a bearing surface to slide the retractor mechanism, and front components angled inward to retain the retractor mechanism and the latch. A plurality of prongs extend from the retainer clip to receive the chassis of the lock assembly.

13 Claims, 4 Drawing Sheets

APPARATUS FOR RETAINING A RETRACTOR MECHANISM IN A LOCK ASSEMBLY

FIELD OF THE INVENTION

The present invention relates to a lock assembly. In particular, the invention relates to an apparatus for retaining a retractor mechanism used to extend and retract a latch of the lock assembly.

BACKGROUND OF THE INVENTION

Lock assemblies generally include a retractor mechanism attached to a latch or bolt and supported by a chassis mounted in a door. The retractor mechanism extends and retracts the latch to secure access through the door.

SUMMARY OF THE INVENTION

Typically, the retractor mechanism must be assembled and installed while building-up a chassis to support the lock assembly in the door. Likewise, removal of the retractor mechanism requires the disassembly of the chassis as well. The present invention provides an innovative design of a retainer apparatus for the retractor mechanism. The retainer apparatus of the invention allows the retractor mechanism to be pre-assembled before or after the chassis has been assembled. Manufacturers and installers of lock assemblies will find this innovative design less cumbersome when assembling and/or dissembling a lock assembly.

In one embodiment, the invention provides a retractor retainer apparatus for a retractor mechanism that extends and retracts a latch. One embodiment of the retainer apparatus is a clip that is operable to hold the retractor mechanism and the latch. The clip includes a back component having a first and second end, the back component having at least one post for mounting a spring to bias the retractor mechanism, a first side component having a first end connected to one end of the back component, and a second side component having a first end connected to the other end of the back component, wherein the first and second side components provide a bearing surface to slide the latch retractor mechanism, and a first front component connected to the second end of the first side component, and a second front component connected to the second end of the second side component, the first and second front components angled inward to form a narrowed gap that retains the latch retractor mechanism and allows extension and retraction of the latch to secure access through the door.

In another embodiment, the invention provides a door lock assembly for securing a door, the lock assembly including a retractor mechanism to linearly extend the latch to a locked position and to retract the latch to an unlocked position, a chassis to support the lock assembly in the door, and a retainer apparatus to hold the retractor mechanism, the retainer apparatus having a back component having at least one post for mounting at least one spring to bias the retractor mechanism, a first and a second side component each having one end connected to each end of the back component, said first and second side components providing a bearing surface for moving the retractor mechanism, a first and a second front component connected to the other ends of the first and the second side components, the front components angled inward to form a narrowed gap, wherein the retainer apparatus retains the retractor mechanism in the chassis.

Briefly summarized, the retractor retainer apparatus is a clip having a back component, a pair of side plate components, and a pair of front plate components that retains a retractor mechanism for extending and retracting a latch. The retainer apparatus allows the retractor mechanism to be pre-assembled, where this sub-assembly is ready for installation or connection to a partially or completely pre-assembled chassis of a lock assembly. One embodiment of the clip is a single formed piece that includes a back component having at least one post for mounting a spring to bias the retractor, side components to provide a bearing surface to slide the retractor for the latch, and front components angled inward to retain the retractor and engage the latch. A plurality of prongs extend from the clip to hold the clip to the chassis of the lock assembly. Manufacturers will find the sub-assembly of the retractor mechanism less cumbersome and time consuming when assembling and/or disassembling the lock assembly.

As is apparent from the above, it is an aspect of the invention to provide a retainer apparatus for a latch retractor mechanism that secures access through a door. Other features and aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
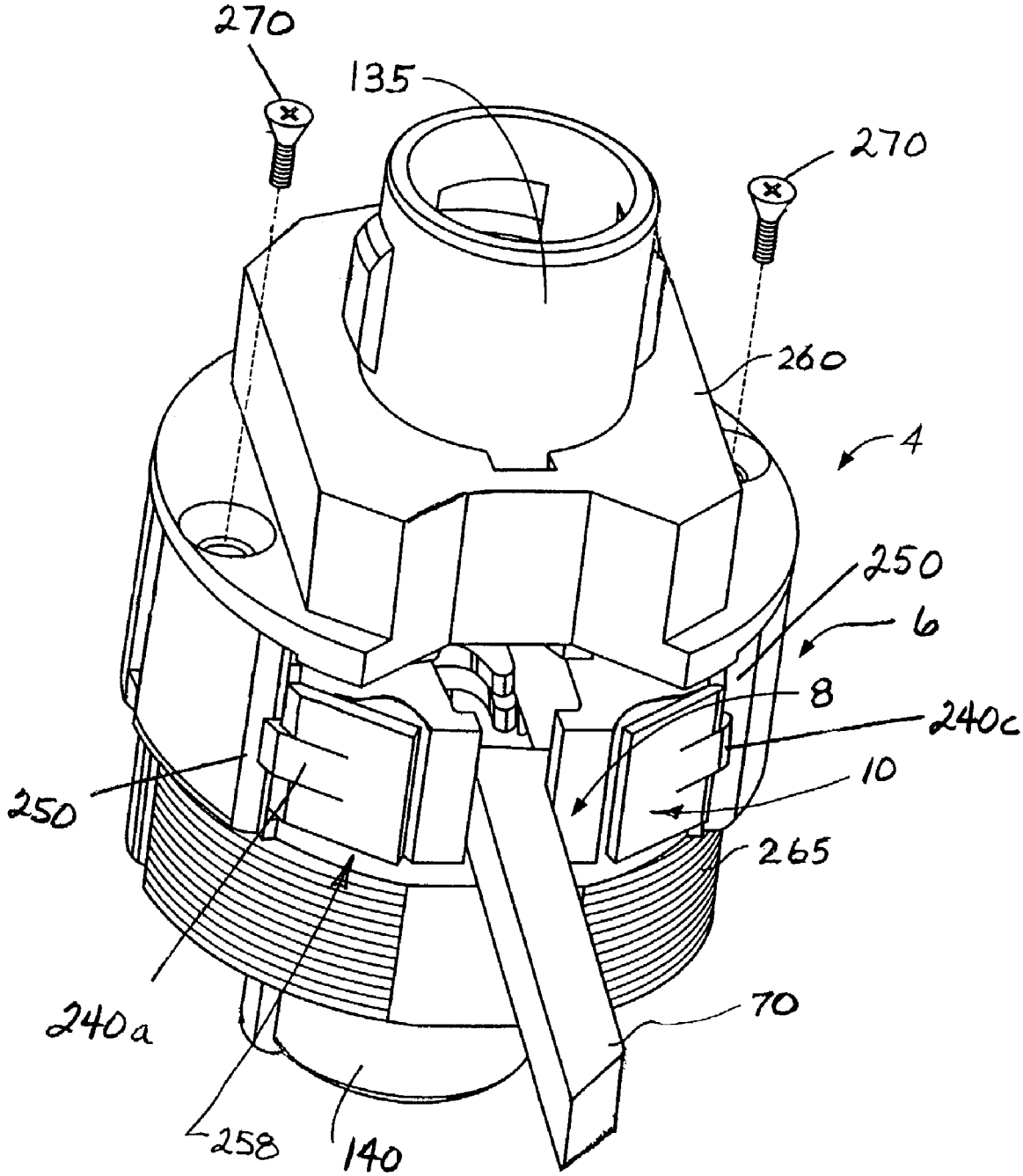
FIG. 1 is a perspective view of a lock assembly with a retractor mechanism and a retractor retainer apparatus.

FIG. 1 illustrates a perspective view of a lock assembly 4 that includes a latch apparatus or retractor assembly 6. One embodiment of the retractor assembly 6 includes a retractor or retractor mechanism 8 retained in a retainer apparatus 10.

Figure 2:
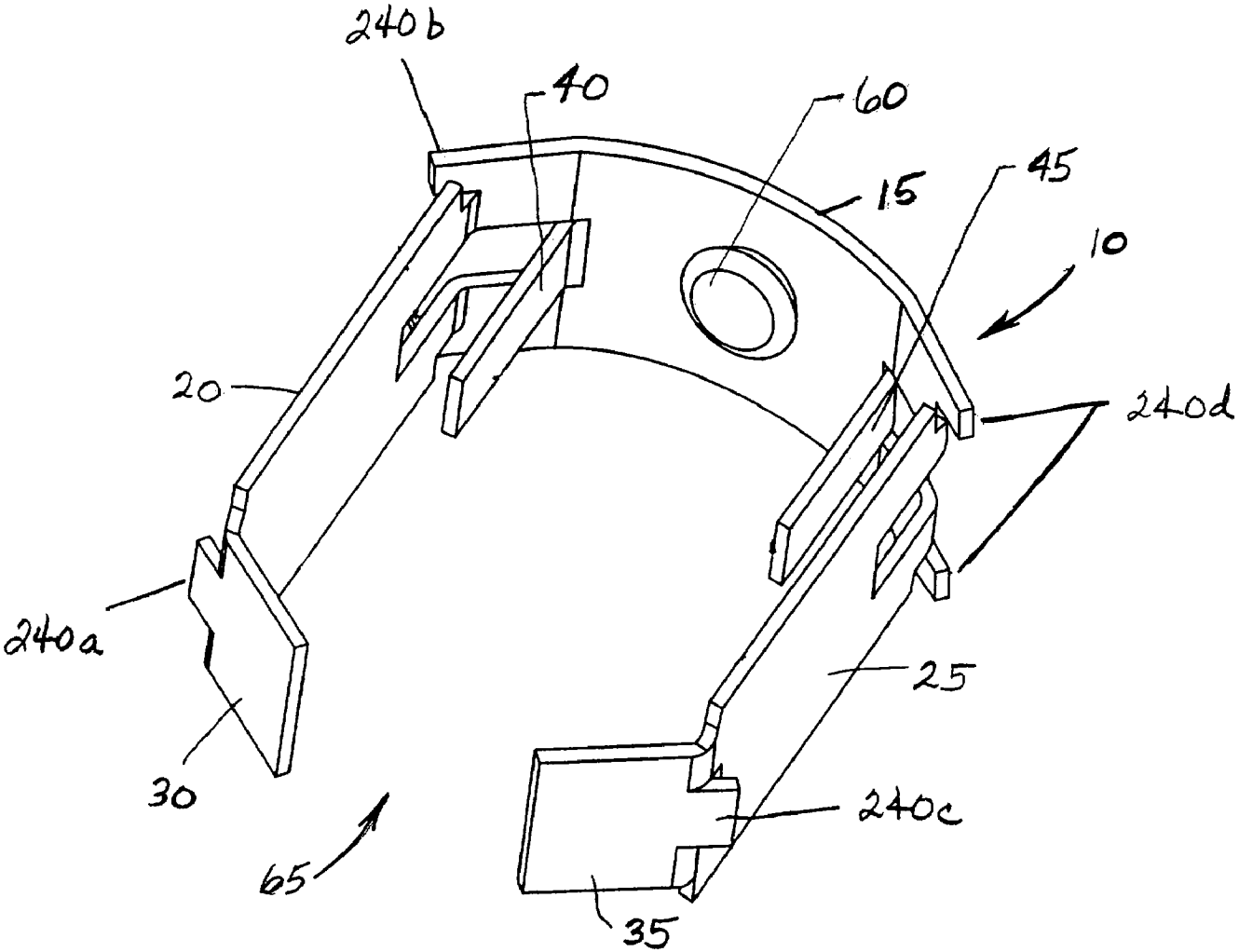
FIG. 2 is a perspective view of the retainer apparatus.

FIG. 2 illustrates one embodiment of the retainer apparatus 10 for retaining the retractor mechanism 8. As illustrated in FIG. 2, the retainer apparatus 10 includes a retainer clip having a back component 15, a first 20 and a second 25 side component, and a first 30 and a second 35 front component. In one embodiment, the back component 15, first 20 and second 25 side components, and first 30 and second 35 front components are machined-formed from a single metal plate (e.g., steel plate). In an alternative embodiment, the components of the retainer apparatus 10 can be created separately and inter-connected using any suitable means (e.g., spot-welded, soldered, etc.) known to those in the art.

Figure 3:
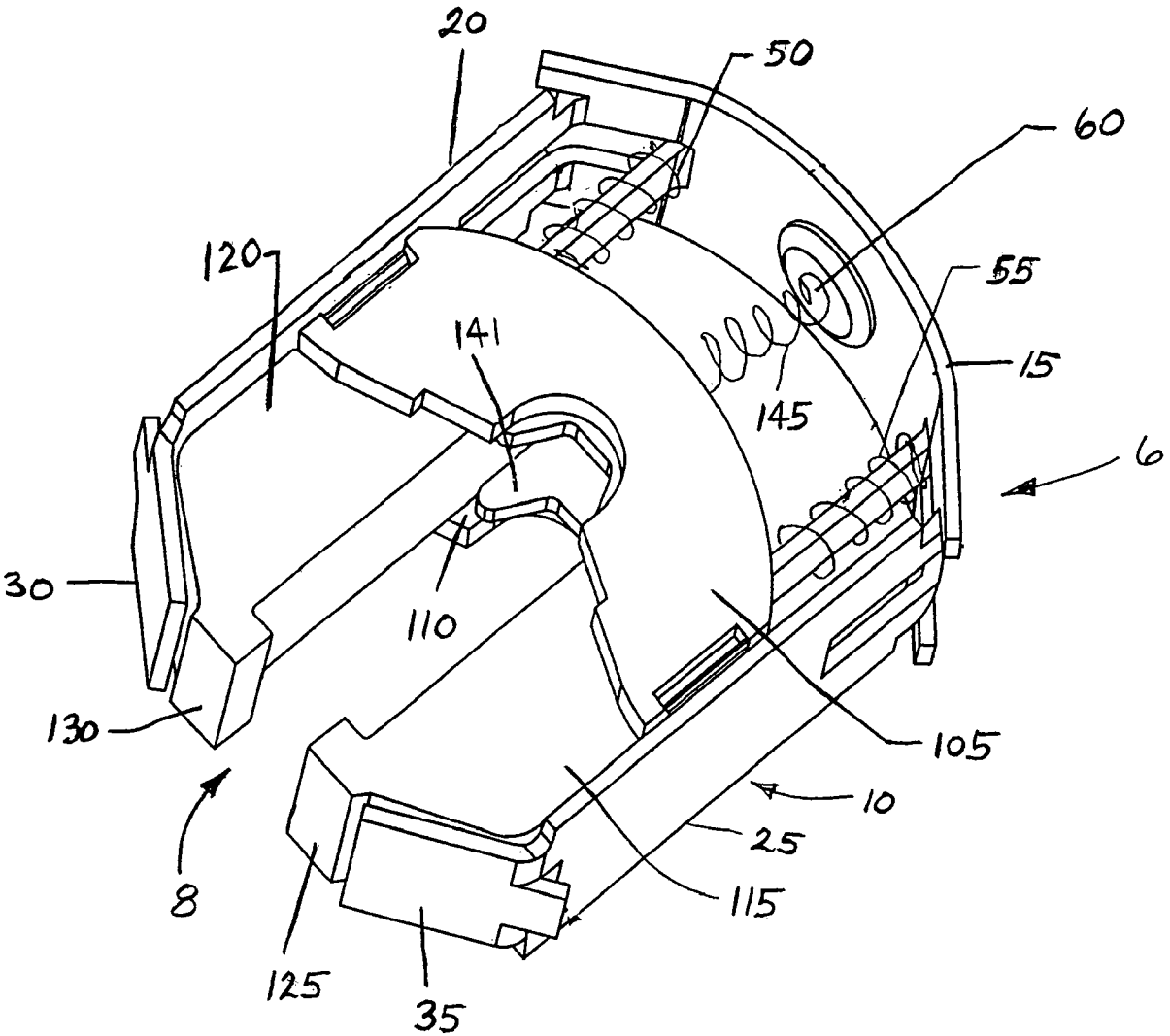
FIG. 3 is a perspective view of the retractor mechanism and retainer apparatus.

As shown in FIG. 2, one embodiment of the back component 15 is a curvilinear-shaped metal plate. The curvilinear shape is designed to conform to the overall shape of the lock assembly 4. In alternative embodiments, the back component 15 can include other shapes (e.g., bends, flat sides, etc.) suitable for the lock assembly 4. Another embodiment of the back component 15 includes a pair of posts 40 and 45. As shown in FIGS. 2 and 3, the posts 40 and 45 support the retractor mechanism springs 50 and 55. One embodiment of the posts 40 and 45 are machined stamped or cut out from the back component 15 and angled in a direction inwardly with respect to or from the back component 15. In another embodiment, the posts 40 and 45 can be separate components attached to the back component 15 using other suitable means (e.g., spot-welded) known to those in the art. In yet another embodiment, the posts 40 and 45 can be stamped or cut out from a portion of the back component 15 and each side component 20 and 25. The back component 15 also includes a catch spring base 60. The catch spring base 60 supports a catch spring biased against a catch of the retractor mechanism 8 (discussed later).

The first 20 and second 25 sides form the bearing surfaces for sliding the retractor mechanism 8 in a linear direction between an extended and a retracted position. As shown in FIG. 2, the first 20 and second 25 side components have one end connected to each end of the back component 15. One embodiment of side components 20 and 25 are flat plates to support the linear sliding of the retained retractor mechanism 8. Of course, the shape of the side components 20 and 25 can vary. The first 20 and the second 25 side components are designed to have some elasticity to enable installation of the retractor mechanism 8.

As shown in FIGS. 2 and 3, the first 30 and second 35 front components constrain the retractor mechanism 8 against the back component 15 and the bias of the springs 50 and 55. FIGS. 2 shows one embodiment of the first 30 and the second 35 front components angled inward with respect to the ends of the first 20 and second 25 side components. The inward-angled front components 30 and 35 form a narrowed gap 65. The width of the gap 65 is designed to constrain the retractor mechanism 8, yet allow the extension and retraction of a latch or bolt 70 (FIG. 1) of the retractor mechanism 8. The first 30 and second 35 front components are also designed with some flexibility for installing the retractor mechanism 8.

FIG. 3 shows a perspective view of the retractor mechanism 8 installed in the retainer apparatus 10. The retractor mechanism 8 slides along the side components 20 and 25 to extend and retract the bolt 70 (FIG. 1). As shown in FIG. 3, one embodiment of the retractor-mechanism 8 includes a first 105 and a second carrier 110, a pair of retractor bars 115 and 120, and the pair of springs 50 and 55. The retractor bars 115 and 120 include a pair of lips 125 and 130 that engage the bolt 70. Drive shafts 135 and 140 (FIG. 1) include cams (not shown) designed to engage the first 105 and second 110 carriers. When rotating drive shaft 135 to retract the bolt 70, the cams of the drive shaft 135 engages the first carrier 105. The rotational force of the drive shaft 135 against the carrier 105 causes the retractor mechanism 8 to slide along the side components 20 and 25 against the bias of the springs 50 and 55. Under the force of the drive shafts 135 and 140, the retractor mechanism 8 retracts the bolt 70. Upon release of the rotational force on the drive shaft 135 and 140, the springs 50 and 55 bias the retractor mechanism 8 forward toward its original position. Thereby, the retractor mechanism 8 slides to extend the bolt 70. The drive shaft 140 engages the carrier 110 in a similar manner as the drive shaft 135.

As shown in FIG. 3, another embodiment of the retractor mechanism 8 further includes a catch 141. The catch 141 engages a spring 145 compressed against the catch spring base 60 of the back component 15, thereby biasing the catch 141 toward an extended position. The catch 141 is operable in holding a plunger bar (not shown) in a locked position.

Figure 4:
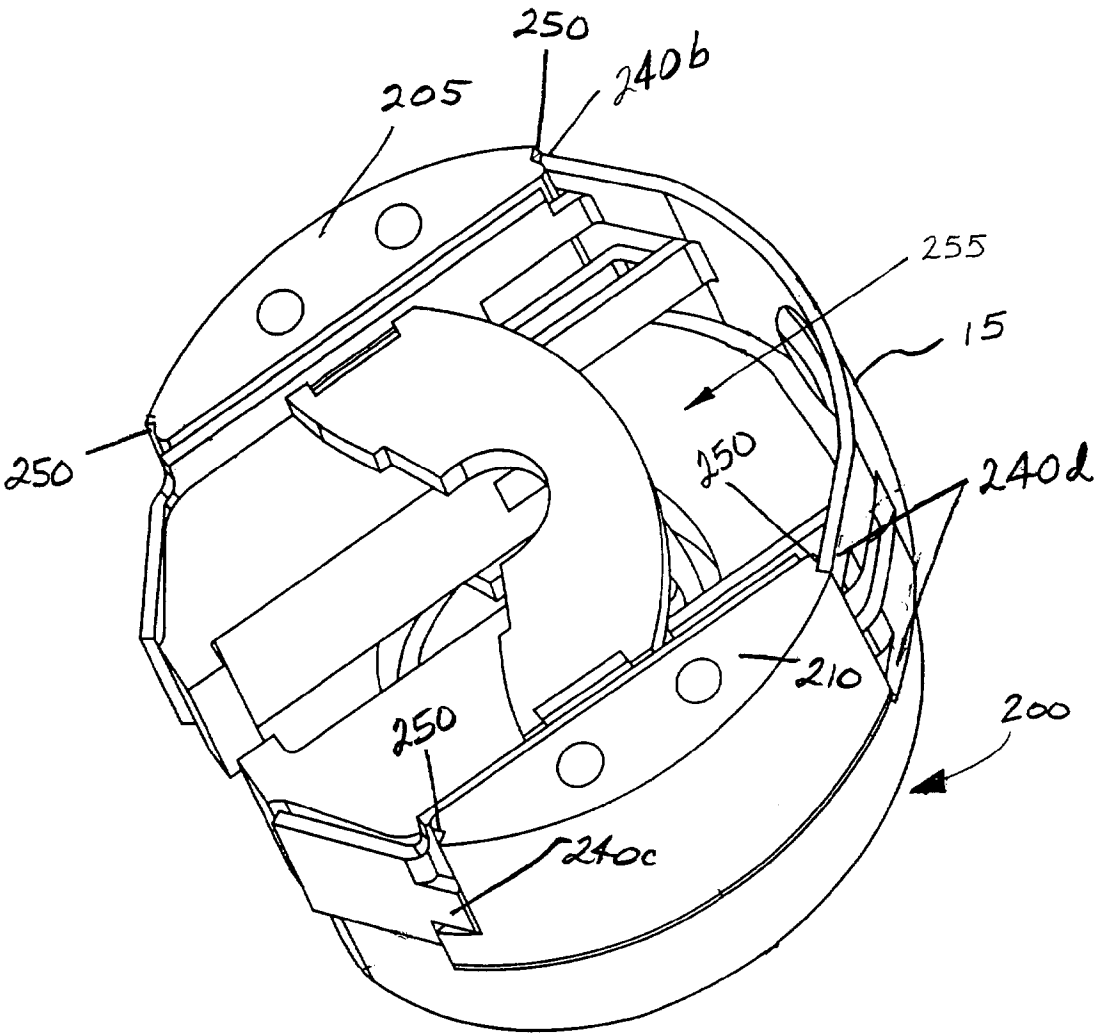
FIG. 4 is a perspective view of the retainer apparatus and retractor mechanism connected to a chassis.

FIG. 4 illustrates a perspective view of a chassis 200 in support of the retractor mechanism 8 and retainer apparatus 10. In one embodiment, the chassis 200 includes a first 205 and a second 210 side support for the retainer apparatus 10. As shown in FIGS. 2 and 4, the retainer apparatus 10 includes a plurality of prongs 240 for receiving the first 205 and second 210 side supports of the chassis 200. The prongs 240 can be one or more extensions at each end of a component and is not limiting on the invention. In one embodiment, the back component 15 includes two pairs of back prongs 240*b* and 240*d* that extend past the first 20 and second 25 side components (FIG. 3). Each pair of back prongs 240*b* and 240*d* extends parallel with the ends of the back component 15. In addition, one embodiment of the front components 30 and 35 include front prongs 240*a* (FIG. 1) and 240*c* that extend outward in a similar fashion past the first 20 and second 25 side plates. Similar to prongs 240*b* and 240*d* in relation to the back 15, the front prongs 240*a* and 240*c* extend parallel with each end of the first 30 and the second 35 front plates. The back prongs 240*b* and 240*d* and the front prongs 240*a* and 240*d* are located at opposite ends of the first 20 and second 25 side components and angled inward to receive the first 205 and second 210 side supports of the chassis 200. One embodiment of the prongs 240*a–d* are machine stamped or cutout from the first 20 and second 25 side components. Of course, the prongs 240*a–d* can be separate components attached using other suitable means (e.g., spot-welded, soldered, etc.) known to those in the art.

As shown in FIG. 4, the first 205 and second 210 side supports of the chassis 200 include reliefs 250 to receive the prongs 240*a–d* of the retainer apparatus 10. One embodiment of a relief 250 is a beveled edge at an angle compatible with the angle of the prongs 240*a–d*. Of course, other shapes (e.g., channels) for a relief 250 in the side supports 205 and 210 of the chassis 200 can be used.

As shown in FIGS. 2–4, the retainer apparatus 10 allows the retractor mechanism 8 to be assembled individually from the build-up of the chassis 200 that supports the lock assembly 4. FIG. 2 illustrates one embodiment of the retainer apparatus 10 that is formed from machine pressing a metal plate. An operator pre-assembles the retractor assembly 6 by flexing the side components 20 and 25, then inserting the retractor mechanism 8 inside the retainer apparatus 10. Upon unflexing the side components 20 and 25, the retractor mechanism is constrained.

Once the retractor assembly 6 is pre-assembled, the retractor assembly 6 can be inserted or connected to the chassis 200 as shown in FIGS. 1 and 4. In one embodiment, the chassis 200 is pre-assembled individually from the retractor assembly 6. Upon individual assembly of the retractor assembly 6 and the chassis 200, an operator can insert or slide the assembled retractor apparatus 6, as shown by arrow 255 in FIG. 4, into an aperture 258 formed by the assembled chassis 200. As described above, the prongs 240*a–d* secure the retractor assembly 6 to the chassis 200. To disassemble the lock assembly 4, the retractor assembly 6 can be removed from the chassis 200 without disassembling the retractor mechanism 8 and/or chassis 200 similar to the method for assembly described above. In one embodiment, an operator can slidingly remove the retractor assembly 6 from the reliefs 250 of the chassis 200 without disassembling the chassis 200. Thereby, the design of the retractor mechanism 8 and retainer apparatus 10 of the invention is more versatile and less cumbersome to assemble and/or disassemble. In another embodiment, the retractor assembly 6 can be slid along the reliefs 250 when assembling the chassis 200 of the lock assembly 4.

FIG. 1 illustrates an exemplary embodiment of a lock assembly 4 with the retractor assembly 6 interconnected through an aperture 258 with an assembled chassis 200. The chassis 200 includes a first 260 and a second 265 hub having openings for receiving the drive shafts 135 and 140. The exemplary first hub 260 and second 265 hubs are mounted using screws 270. Of course, other suitable connection means (e.g., spot-weld, cast, etc.) known in the art can be used. One embodiment of the chassis 200 is comprised of cast metal. Of course, the chassis 200 can be comprised of cast metal and/or one or more other suitable materials (e.g., forged metal, plastic) known in the art of lock assemblies.

Thus, the invention provides, among other things, a retractor assembly having a retractor mechanism retained in a retainer apparatus for connection to a chassis of a lock assembly. Various features and advantages of the invention are set forth in the following claims.

What is claimed is:

1. A lock assembly comprising:

a latch;

a chassis with two spaced apart side supports and two spaced apart hubs, each hub being mounted each one of the side supports, the two side supports and the two hubs at least partially defining an aperture; and a retractor assembly including a slidable retractor mechanism for extending and retracting the latch and a retainer clip having a back component, two spaced-apart side components extending from the back component, two front components each connected with an end of a separate one of the side components, the two front components being angled inward generally toward each other to form a narrowed gap, the clip being configured to receive the retractor mechanism such that the two side components extend on opposing sides of at least a portion of the retractor mechanism and the retractor mechanism is retained generally between the two side components and between the back component and the two front components, the latch extending through the gap between the front components, the retractor mechanism being slideable generally along bearing surfaces of the two side members to extend and to retract the latch, the retainer clip further having prongs releasably engageable with the chassis such that the retractor assembly is installable within the assembled chassis by sliding the clip into the chassis aperture to engage the prongs with the chassis and removable from the chassis by sliding the clip out of the aperture to disengage the prongs from the chassis without disassembling the chassis.

2. The retainer apparatus of claim 1, wherein the back component has a first and a second end, the back component having at least one post for mounting a spring to bias the retractor mechanism, one of the two side components being a first side component having a first end connected to one end of the back component, and the other one of the two side components being a second side component having a first end connected to the other end of the back component.

3. The retainer apparatus as claimed in claim 1 wherein a plurality of the prongs extend from the back component and are cutout and angled from the back component.

4. The retainer apparatus as claimed in claim 3, wherein the back component is substantially rectangular-shaped, and wherein the plurality of prongs include a pair of prongs at each end of the back component.

5. The retainer apparatus as claimed in claim 3, wherein the plurality of prongs are angled to constrain the retainer apparatus in a chassis against the force of the at least one spring to extend the latch.

6. The retainer apparatus as claimed in claim 2, further comprising:

a plurality of prongs extending from the first and the second front components, wherein the prongs constrain the retainer apparatus to a chassis of the lock assembly.

7. The retainer apparatus as claimed in claim 6, wherein the plurality of prongs are machine stamped and angled from the first and the second front components.

8. The retainer apparatus as claimed in claim 6, wherein the first and the second side components are substantially rectangular-shaped, and wherein the plurality of prongs include at least one prong extending from the first and the second front components.

9. The retainer apparatus as claimed in claim 6, wherein the plurality of prongs extending from the front components are angled and positioned against the chassis to resist a force applied to the retractor mechanism to retract the latch.

10. The retainer apparatus as claimed in claim 2, wherein the at least one post is cutout and angled inwardly from the back component.

11. The retainer apparatus as claimed in claim 10, wherein the number of posts is two.

12. The retainer apparatus as claimed in claim 1, wherein the clip is a single formed piece comprised of a machined metal plate.

13. A retainer apparatus comprising:

a retainer clip operable to hold a retractor mechanism for a latch of a lock assembly such that the retractor mechanism is operable to slide in the retainer clip to extend and to retract the latch of a lock assembly and including:

a substantially rectangular-shaped back component having a first and a second end, the back component having at least one post for mounting a spring to bias the retractor mechanism;

a first side component having a first end connected to one end of the back component, and a second side component having a first end connected to the other end of the back component, wherein the first and the second side components include a bearing surface to slide the retractor mechanism;

a first front component connected to the second end of the first side component, and a second front component connected to the second end of the second side component, the first and the second front components angled inward to form a narrowed gap to retain the retractor mechanism and to allow the latch to move between an extended and a retracted position to secure access through a door; and a plurality of prongs extending from the back component, wherein the prongs constrain the retainer apparatus to a chassis, the plurality of prongs are cutout and angled from the back component, and the plurality of prongs include a pair of prongs at each end of the back component.

* * * * *